US008587624B2

(12) United States Patent
Nakagawa et al.

(10) Patent No.: US 8,587,624 B2
(45) Date of Patent: Nov. 19, 2013

(54) RECORDING HEAD AND RECORDING DEVICE COMPRISING SAME

(75) Inventors: Hidenobu Nakagawa, Kirishima (JP); Yoichi Moto, Kirishima (JP); Makoto Miyamoto, Kirishima (JP)

(73) Assignee: Kyocera Corporation, Kyoto (JP)

( * ) Notice: Subject to any disclaimer, the term of this patent is extended or adjusted under 35 U.S.C. 154(b) by 32 days.

(21) Appl. No.: 13/388,046

(22) PCT Filed: Aug. 26, 2010

(86) PCT No.: PCT/JP2010/064473
§ 371 (c)(1),
(2), (4) Date: Jan. 30, 2012

(87) PCT Pub. No.: WO2011/024893
PCT Pub. Date: Mar. 3, 2011

(65) Prior Publication Data

US 2012/0125568 A1 May 24, 2012

(30) Foreign Application Priority Data

Aug. 27, 2009 (JP) ..... 2009-196329
Feb. 17, 2010 (JP) ..... 2010-032364

(51) Int. Cl.
*B41J 2/335* (2006.01)

(52) U.S. Cl.
USPC ..... 347/200

(58) Field of Classification Search
USPC ..... 347/200, 201, 202, 203, 204, 205
See application file for complete search history.

(56) References Cited

U.S. PATENT DOCUMENTS

| | | | | |
|---|---|---|---|---|
| 6,686,945 | B1 * | 2/2004 | Takizawa et al. | 347/208 |
| 7,248,274 | B2 * | 7/2007 | Takeya et al. | 347/200 |
| 7,250,960 | B2 * | 7/2007 | Takeya et al. | 347/200 |

FOREIGN PATENT DOCUMENTS

| | | |
|---|---|---|
| JP | 10-100456 | 4/1998 |
| JP | 2001096780 A | 4/2001 |
| JP | 2002137428 A | 5/2002 |
| JP | 2005-096274 | 4/2005 |
| JP | 2007-245671 | 9/2007 |
| JP | 2008-201013 | 9/2008 |

OTHER PUBLICATIONS

Machine-generated translation of JP 2007-245671, published on Sep. 2007.*
Machine-generated translation of JP 2005-096274, published on Apr. 2005.*
Extended European search report dated Jan. 24, 2013 issued in corresponding European application 10811942.1.

* cited by examiner

*Primary Examiner* — Huan Tran
(74) *Attorney, Agent, or Firm* — DLA Piper LLP (US)

(57) ABSTRACT

There are provided a recording head capable of reduction of variations in heat-generating temperature among heat-generating elements constituting a heat-generating-element array, and a recording device including the recording head. A recording head includes a heat radiator; a head base body having a substrate placed on or above the heat radiator and a heat-generating-element array composed of a plurality of heat-generating elements arranged on or above the substrate; a bonding layer that is interposed between the heat radiator and the substrate and bonds the heat radiator with the substrate; and a plurality of spacer particles arranged within the bonding layer so as to abut on both of the heat radiator and the substrate. The bonding layer includes a first region situated immediately below the heat-generating-element array and a second region extending in parallel with the first region. The spacer particles are arranged in the second region.

8 Claims, 11 Drawing Sheets

(a)

(b)

(a)

(b)

(a) DISTANCE FROM STARTING POSITION: 10 cm (b) DISTANCE FROM STARTING POSITION: 20 cm (c)

RECORDING HEAD AND RECORDING DEVICE COMPRISING SAME

CROSS-REFERENCE TO THE RELATED APPLICATIONS

This application is a national stage of international application No. PCT/JP2010/064473, filed on Aug. 26, 2010, and claims the benefit of priority under 35 USC 119 to Japanese Patent Application No. 2009-196329, filed on Aug. 27, 2009 and Japanese Patent Application No. 2010-032364, filed on Feb. 17, 2010, the entire contents of all of which are incorporated herein by reference.

TECHNICAL FIELD

The present invention relates to a recording head and a recording device including the recording head.

BACKGROUND ART

A variety of recording heads such as a thermal head have been proposed to date as printing devices for use in facsimiles, video printers, and so forth. For example, a thermal head (thermal print head) disclosed in Patent Literature 1 is constructed by placing a support substrate, which bears an array of a plurality of heat-generating elements on its upper face, on a heat radiator plate via a heat-radiative adhesive and a double-sided tape. A layer of the heat-radiative adhesive (hereafter referred to as "adhesive layer") contains powder made of alumina ceramics or the like, the particle size of which is substantially the same as the thickness of the adhesive layer.

CITATION LIST

Patent Literature

Patent Literature 1: Japanese Unexamined Patent Publication JP-A 2008-201013

SUMMARY OF INVENTION

Technical Problem

In the thermal head disclosed in Patent Literature 1, the adhesive layer is situated in a region below the heat-generating-element array composed of a plurality of heat-generating elements, and the powder made e.g. of alumina ceramics is contained within the layer. Therefore, due to the scattering of the powder particles placed within the adhesive layer, heat-radiation property varies over different portions of the adhesive layer, which results in variations in heat-generating temperature among the heat-generating elements constituting the heat-generating-element array.

The invention has been devised to solve the problem as mentioned supra, and accordingly an object of the invention is to provide a recording head capable of reduction of variations in heat-generating temperature among heat-generating elements constituting a heat-generating-element array, and a recording device including the recording head.

Solution to Problem

A recording head in accordance with one embodiment of the invention includes a heat radiator; a head base body having a substrate placed on or above the heat radiator and a heat-generating-element array composed of a plurality of heat-generating elements arranged on or above the substrate; a bonding layer that is interposed between the heat radiator and the substrate and bonds the heat radiator with the substrate; and a plurality of spacer particles arranged within the bonding layer so as to abut on both of the heat radiator and the substrate. The bonding layer includes a first region situated immediately below the heat-generating-element array and a second region extending in parallel with the first region. The spacer particles are arranged in the second region.

In the recording head in accordance with one embodiment of the invention, the second region of the bonding layer may be formed of a double-sided tape.

Moreover, the first region of the bonding layer may be formed of an adhesive.

Moreover, the spacer particles may be arranged along the heat-generating-element array.

Moreover, second regions of the bonding layer may be arranged on both sides of the first region. In this case, the spacer particle placed in one of the second regions of the bonding layer may be opposed to the spacer particle placed in another one of the second regions, with the first region lying between them, and a distance from the heat-generating-element array to the spacer particle placed in the one of the second regions may be equal to a distance from the heat-generating-element array to the spacer particle placed in the other one of the second regions.

A recording device in accordance with one embodiment of the invention includes the recording head in accordance with one embodiment of the invention mentioned above; and a conveyance mechanism configured so as to convey a recording medium onto the plurality of heat-generating elements. The conveyance mechanism has a platen roller configured to press the recording medium on the plurality of heat-generating elements.

In the recording device in accordance with one embodiment of the invention, the second region of the bonding layer may extend at least to a region corresponding to a region of contact between the recording head and the platen roller, and the spacer particle may be placed in a part of the second region of the bonding layer which corresponds to the region of contact.

Advantageous Effects of Invention

According to the invention, it is possible to provide a recording head capable of reduction of variations in heat-generating temperature among heat-generating elements constituting a heat-generating-element array, and a recording device including the recording head.

DESCRIPTION OF EMBODIMENTS

Hereinafter, an embodiment of a thermal head implemented by way of one embodiment of a recording head pursuant to the invention will be described with reference to the drawings.

Figure 1:
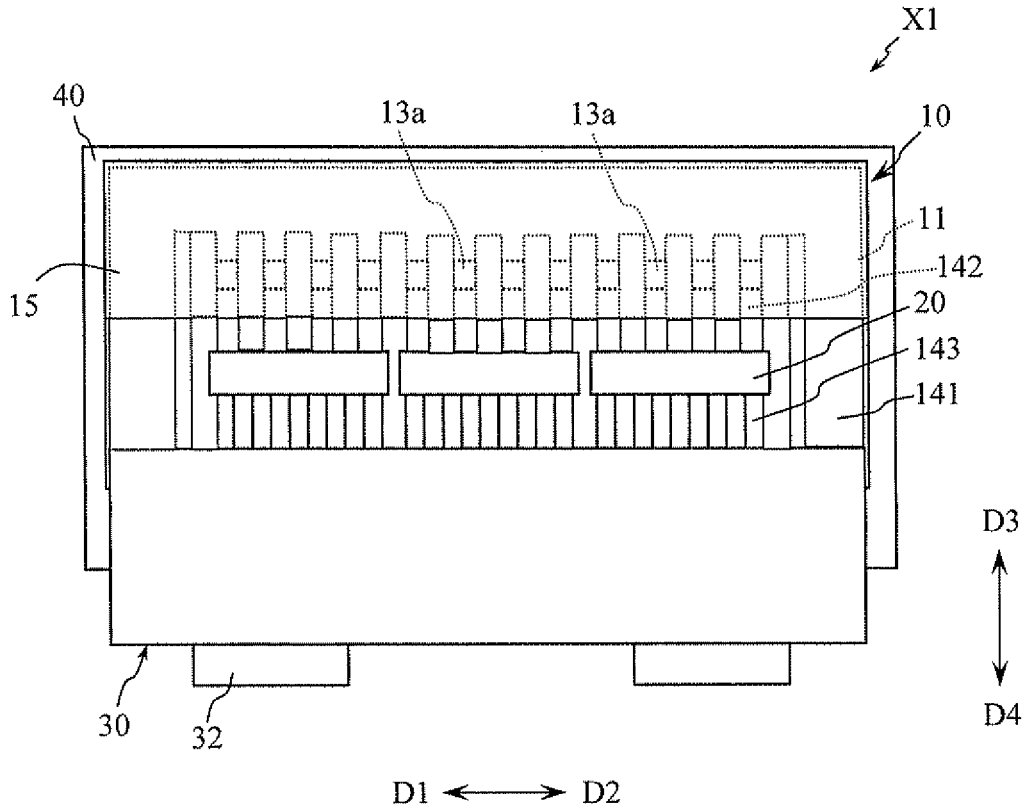
FIG. 1(*a*) is a plan view showing the general structure of one embodiment of a thermal head implemented by way of one embodiment of a recording head pursuant to the invention, and FIG. 1(*b*) is a side view of the thermal head shown in FIG. 1(*a*)
Figure 1:
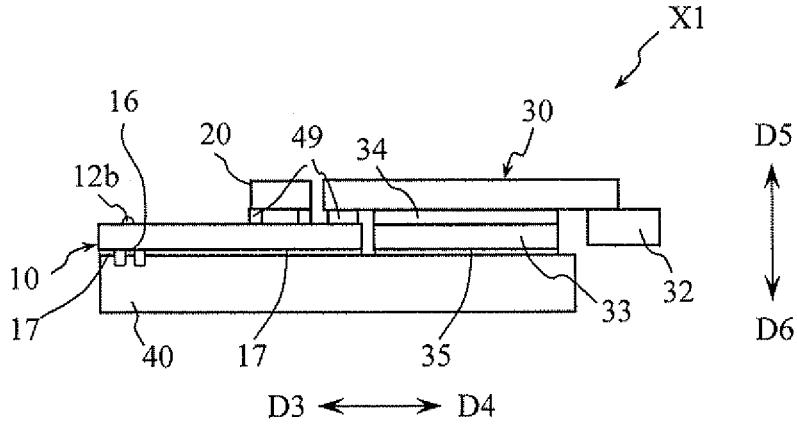
Figure 2:
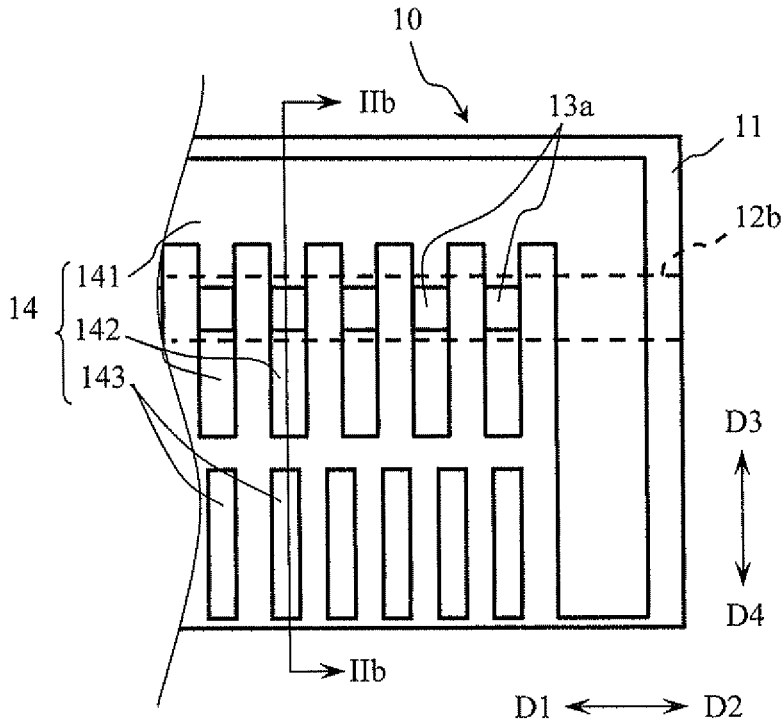
FIG. 2(*a*) is an enlarged plan view showing a main part of the thermal head shown in FIG. 1, and FIG. 2(*b*) is a sectional view of the thermal head taken along the line IIb-IIb shown in FIG. 2(*a*)
Figure 2:
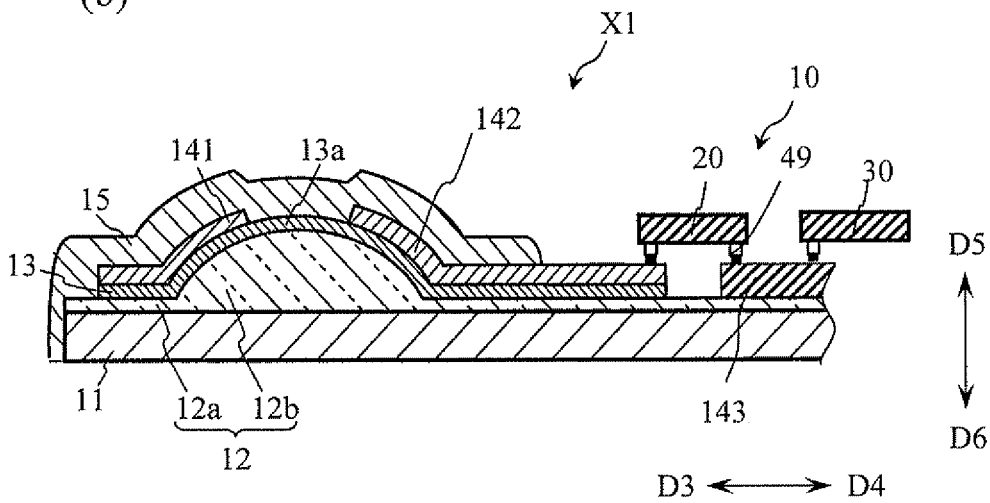

As shown in FIGS. 1 and 2, a thermal head X1 of the embodiment is composed of a head base body 10, a driving IC 20, a wiring member 30, and a heat radiator 40. For convenience in explanations, in FIG. 2(*a*), the driving IC 20, the wiring member 30, the heat radiator 40, and a protective layer 15 which will hereafter be described are omitted, and, in FIG. 2(*b*), the heat radiator 40 is omitted.

The head base body 10 includes a head substrate (substrate) 11, and also a glaze layer 12, an electrical resistance layer 13, and an electrode wiring line 14 that are formed sequentially in the order named on the head substrate 11. Moreover, the glaze layer 12 includes a flat base part 12*a* and a protuberant part 12*b* extending from the upper face of the base part 12*a*. That region of the electrical resistance layer 13 which is situated at the top of the protuberant part 12*b* of the glaze layer 12 bears no electrode wiring line 14 on its upper face, and this electrode wiring line-free region constitutes a heat-generating element 13*a*. The upper face of the heat-generating element 13*a*, as well as the upper face of the electrode wiring line 14 in part, is formed with the protective layer 15.

The head substrate 11 has the function of supporting the glaze layer 12, the electrical resistance layer 13, the electrode wiring line 14, the protective layer 15, and the driving IC 20. The head substrate 11 has, when viewed in a plan view, a shape of a rectangle extending along a D1-D2 direction indicated by arrows, and thus has a rectangular main surface. Examples of the material used for forming the head substrate 11 include an electrically insulating material. For example, inorganic materials such as ceramic materials such as alumina ceramics or glass materials are suitable for use.

In the interest of facilitation of patterning of the electrical resistance layer 13 and the electrode wiring line 14 by means of photolithography, improvement in smoothness, and ease of manufacture, the glaze layer 12 is formed over the entire upper face of the head substrate 11.

The glaze layer 12 has the function of temporarily accumulating part of heat produced in the heat-generating element 13*a* of the electrical resistance layer 13 that will hereafter be described. That is, the glaze layer 12 acts to enhance the thermal responsive characteristic of the thermal head X1 by shortening the time required for a rise in the temperature of the heat-generating element 13*a*. For example, glass can be used as a material for forming the glaze layer 12.

The base part 12*a* of the glaze layer 12 is made substantially flat so as to extend over the entire upper face of the head substrate 11, and has a thickness of 20 μm to 250 μm. The protuberant part 12*b* of the glaze layer 12 is a portion which is conducive to pressing a recording medium smoothly against the protective layer 15 situated on the heat-generating element 13*a*. The protuberant part 12*b* extends along an upward direction (a D5 direction) beyond the base part 12*a*. Moreover, the protuberant part 12*b* is shaped like a strip extending in a main scanning direction (the D1-D2 direction). The protuberant part 12*b* is configured to have a substantially semi-elliptical cross-sectional profile, looking in a subscanning direction (a D3-D4 direction) perpendicular to the main scanning direction (the D1-D2 direction). In the embodiment, the direction of arrangement of the heat-generating elements 13*a* corresponds to the main scanning direction of the thermal head X1. Note that the glaze layer 12 does not necessarily have to be formed over the entire upper face of the head substrate 11 in so far as it lies at least in a region between the heat-generating element 13*a* and the head substrate 11.

The electrical resistance layer 13 is formed on the glaze layer 12, and has a thickness of 0.01 μm to 0.5 μm. In the embodiment, of the electrical resistance layer 13 which receives application of voltage from the electrode wiring line 14, the electrode wiring line 14-free part serves as the heat-generating element 13*a*, and the heat-generating element 13*a* is formed on the protuberant part 12*b* of the glaze layer 12. Examples of the material used for forming the electrical resistance layer 13 include a TaN-based material, a TaSiO-based material, a TaSiNO-based material, a TiSiO-based material, a TiSiCO-based material, and a NbSiO-based material.

The heat-generating element 13*a* produces heat through the application of voltage from the electrode wiring line 14. The heat-generating element 13*a* is so designed that the temperature of heat produced through the application of voltage from the electrode wiring line 14 falls in a range of from 200° C. to 550° C., for example.

Moreover, the heat-generating elements 13*a* are arranged in a row at a predetermined spacing along the arrow-indicated D1-D2 direction, which constitute a heat-generating-element array. Note that, in the embodiment, two or more rows of the heat-generating-element arrays may be provided.

The electrode wiring line 14 includes a first electrode wiring line 141, a second electrode wiring line 142, and a third electrode wiring line 143.

The first electrode wiring line 141 is connected, at its end, to one ends of a plurality of the heat-generating elements 13*a*, as well as to a power supply device (not shown). The one end of the first electrode wiring line 141 is located on a side of the heat-generating element 13*a* toward the arrow-indicated D3 direction.

Each of the second electrode wiring lines 142 has its one end connected to the other end of the heat-generating element 13*a*, and has its other end connected to the driving IC 20. The one end of the second electrode wiring line 142 is located on a side of the heat-generating element 13*a* toward the arrow-indicated D4 direction.

The third electrode wiring line 143 is formed so as to be away from the second electrode wiring line 142. Expressed differently, the third electrode wiring line 143 is disposed in proximity to the second electrode wiring line 142. The third electrode wiring lines 143 are situated between a plurality of the driving ICs 20 and the wiring member 30. Moreover, the third electrode wiring line 143 is connected to the driving IC 20 and the wiring member 30 for establishment of electrical connection between the driving IC 20 and the wiring member 30.

Examples of the material used for forming the first electrode wiring line 141, the second electrode wiring line 142, and the third electrode wiring line 143 include any one of the following metals: aluminum, gold, silver, and copper, and an alloy of these metals. The thickness of the electrode wiring line falls in a range of 0.7 μm to 1.2 μm.

The protective layer 15 has the function of protecting the heat-generating element 13*a* and the electrode wiring line 14. The protective layer 15 covers the heat-generating element 13*a* and part of the electrode wiring line 14. Examples of the material used for forming the protective layer 15 include a diamond-like carbon material, a SiC-based material, a SiN-based material, a SiCN-based material, a SiAlON-based material, a $SiO_2$-based material, and a TaO-based material. The protective layer 15 is formed of such a material by means of sputtering or otherwise. As used herein, the term "diamond-like carbon material" refers to a material in which the proportion of carbon atoms (C atoms) having $sp^a$ hybridized orbital is greater than or equal to 1% (by atom) but less than 100% (by atom).

The driving IC 20 has the function of exercising control of power supply to the plurality of heat-generating elements 13*a*. The driving IC 20 is connected, at its connection terminal, to the top of the second electrode wiring line 142 and the third electrode wiring line 143 via an electrically conductive connecting member 49 made of solder. By virtue of such a configuration, it is possible to cause the heat-generating elements 13*a* to produce heat in a selective manner in response to electric signals inputted through the electrode wiring line 14.

As shown in FIG. 2, the wiring member 30 is connected, at its connection terminal, to the first electrode wiring line 141 and the third electrode wiring line 143 via the electrically conductive connecting member 49 made of solder. The wiring member 30 has the function of transmitting externally-delivered electric signals to the driving IC 20 and the electrode wiring line 14. For example, the electric signals are indicative of the supply of power to the heat-generating element 13*a* and the driving IC 20, and image information for selective control of the power-supplied conditions of the heat-generating elements 13*a*.

Figure 3:
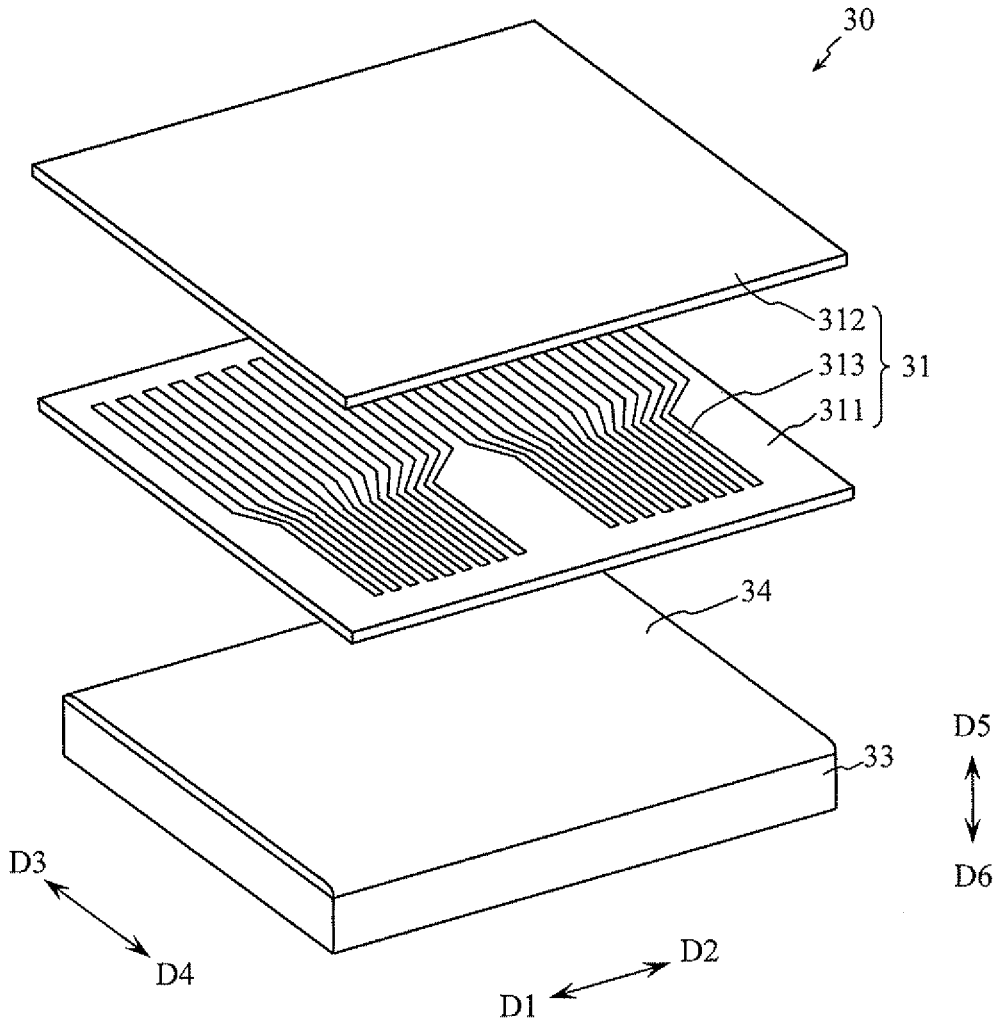
FIG. 3 is an exploded perspective view showing a general structure of a wiring member shown in FIG. 1.

As shown in FIGS. 1 and 3, the wiring member 30 of the embodiment is composed of a wiring body 31, an external connection terminal 32, a support plate 33, and a first bonding layer 34.

The wiring body 31, which exhibits flexibility, includes a first wiring body 311, a second wiring body 312, and a wiring portion 313.

The first wiring body 311 and the second wiring body 312 support a plurality of the wiring portions 313, for ensuring the electrical insulation properties. The first wiring body 311 and the second wiring body 312 are arranged, with the wiring portions 313 sandwiched in between. Examples of the material used for forming the first wiring body 311 and the second wiring body 312 is a flexible resin material such as polyimide-based resin, epoxy-based resin, and acrylic resin. In the embodiment, the wiring body 31 is made of a polyimide-based resin, and has a thermal expansion coefficient given as about $1.1\times10^{-5}K^{-1}$. Moreover, in the embodiment, the first wiring body 311 and the second wiring body 312 have a thickness of 0.5 mm to 2.0 mm, for example.

Examples of the material used for forming the wiring portion 313 include any one of the following metals: gold, silver, copper, and aluminum, and an alloy of these metals. In the embodiment, the wiring portion 313 is made of copper, and has a thermal expansion coefficient given as about $1.7\times10^{-5}K^{-1}$.

The external connection terminal 32 is a portion which receives external input of electric signals. The external connection terminal 32 is electrically connected to the driving IC 20 and the electrode wiring line 14 via the wiring portion 313. For convenience in explanations, in FIG. 3, the external connection terminal 32 is omitted.

The support plate 33 has the function of supporting the wiring body 31. Examples of the material used for forming the support plate 33 include a ceramic material, a resin material, and a ceramic-resin composite material. Examples of the ceramic material include alumina ceramics, aluminum nitride ceramics, silicon carbide ceramics, silicon nitride ceramics, glass ceramics, and mullite sintered compact. Examples of the resin material include thermosetting resin, ultraviolet-curable resin, and chemical reaction-curable resin such as epoxy-based resin, polyimide-based resin, acrylic resin, phenolic resin, and polyester-based resin. In the embodiment, the support plate 33 is formed of a material in which epoxy-based resin is impregnated in glass fibers, and has a thermal expansion coefficient given as about $1.7\times10^{-5}K^{-1}$.

The first bonding layer 34 has the function of bonding the wiring body 31 with the support plate 33. The thickness of the first bonding layer 34 falls in a range of 10 μm to 35 μm, for example.

As shown in FIG. 1, the support plate 33 is bonded onto the heat radiator 40 by a second bonding layer 35 made for example of a double-sided tape.

As shown in FIG. 1, the heat radiator 40 has the function of transferring heat generated by the driving operation of the heat-generating element 13*a* to the outside. Moreover, in the embodiment, the heat radiator 40 serves as a support base for the head base body 10 and the wiring member 30. Examples of the material used for forming the heat radiator 40 include a metal material such as copper and aluminum.

Figure 4:
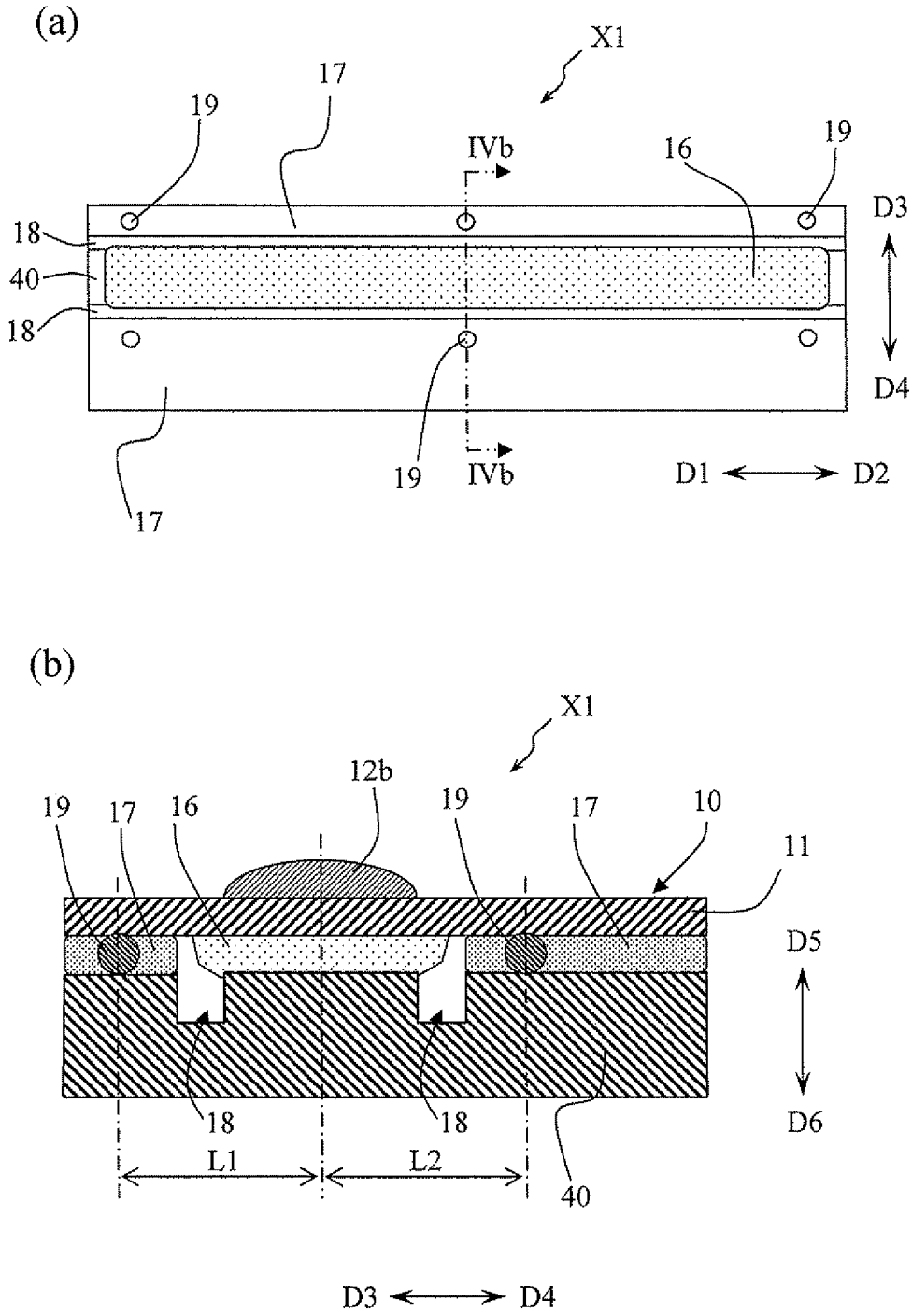
FIG. 4 is a schematic structural diagram showing a state of connection between a head base body and a heat radiator shown in FIG. 1, wherein FIG. 4(*a*) is a plan view with the head base body omitted, and FIG. 4(*b*) is a sectional view taken along the line IVb-IVb of FIG. 4(*a*)

FIG. 4 is a schematic structural diagram showing a state of connection between the head base body 10 and the heat radiator 40 in the thermal head X1 of the embodiment. As shown in FIG. 4, the head base body 10 is placed on the heat radiator 40, and an adhesive layer 16 and a double-sided tape 17 are interposed between the head base body 10 and the heat radiator 40. Note that, in FIG. 4, there is shown only the main part of the heat radiator 40 near the head base body 10, and a part of the heat radiator 40 located toward the wiring member 30 is omitted.

More specifically, the adhesive layer 16 is interposed between that region of the lower face of the head substrate 11 located immediately below the heat-generating-element array (an array composed of the plurality of heat-generating elements 13*a*) (hereafter referred to as "the first lower-face region") and the heat radiator 40. The adhesive layer 16 extends along the direction of arrangement of the heat-generating elements 13*a*, and permits bonding of the first lower-face region with the heat radiator 40. The double-sided tape 17 is interposed between that region of the lower face of the head substrate 11 which extends in parallel with the first lower-face region (hereafter referred to as "the second lower-face region") and the heat radiator 40. The double-sided tape 17 extends in the direction of arrangement of the heat-generating elements 13*a*, and permits bonding of the second lower-face region with the heat radiator 40. The reason for bonding the head base body 10 onto the heat radiator 40 by the adhesive layer 16 and the double-sided tape 17 is to ensure that, when the head base body 10 is subjected to a force which causes it to distort due to the difference in thermal expansion coefficient between the head base body 10 and the heat radiator 40, the difference in extension between the head base body 10 and the heat radiator 40 under thermal expansion can be accommodated by exploiting the in-plane flexibility of the double-sided tape 17, with the consequent lessening of distortion of the head base body 10.

For convenience in explanations, in FIG. 4(*a*), the head base body 10 as shown in FIG. 4(*b*) is omitted, and, in FIG. 4(*b*), the head base body 10 is illustrated as comprising only the head substrate 11 and the protuberant part 12*b* of the glaze layer 12. Moreover, as shown in FIG. 4(*b*), in the embodiment, the bonding layer pursuant to the invention is composed of the adhesive layer 16 and the double-sided tape 17. More specifically, the first region situated immediately below the heat-generating-element array composed of the plurality of heat-generating elements 13*a* is implemented by the adhesive layer 16, and the second regions extending in parallel with the first region on both sides of the adhesive layer 16 are implemented by the double-sided tape 17.

The adhesive layer 16 is formed of an adhesive made of heat-radiative resin. For example, the adhesive is made of filler-containing silicone resin, epoxy-based resin, polyimide-based resin, acrylic resin, phenolic resin, polyester-based resin, or the like of thermosetting type, ambient temperature-curable type, or chemical reaction-curable type.

The double-sided tape 17 is formed of an adhesive free from a base material such as nonwoven cloth, for example, an acrylic adhesive.

As shown in FIG. 4, the double-sided tape 17 contains a plurality of internally-arranged spacer particles 19 abutting on both of the lower face of the head substrate 11 and the heat radiator 40. More specifically, the spacer particles 19 are provided in the form of spherical particles of the same particle size, and one spacer particle 19 is placed at each of the opposite ends of the double-sided tape 17 in the direction of arrangement of the heat-generating elements 13*a* (the right and left ends of the double-sided tape 17, as viewed in FIG. 4(*a*)), and also one spacer particle 19 is placed at the midportion thereof in that direction. Moreover, these three spacer particles 19 are arranged on a straight line extending along the direction of arrangement of the plurality of heat-generating elements 13*a*.

In order to simplify an understanding of the construction, in FIG. 4(*a*), the contour of each spacer particle 19 embedded in the double-sided tape 17 is indicated by a solid line. Moreover, in the explanation of the embodiment, although the spacer particles 19 are described as having the same particle size, it means not only that they are precisely identical in particle size, but also that they have substantially the same particle size, with an allowance made for size differences within the bounds of ±5%. Further, such a spacer particle 19 is not placed within the adhesive layer 16 of the embodiment.

Moreover, in the embodiment, as shown in FIG. 4, the double-sided tapes 17 containing the spacer particles 19 are placed on both sides of the heat-generating-element array (placed above and below the heat-generating-element array, as viewed in FIG. 4(*a*)), and placed on the right and left of the heat-generating-element array, as viewed in FIG. 4(*b*)). Since the head base body 10 and the heat radiator 40 are fixedly bonded to each other by this double-sided tape 17, it is possible for the head base body 10 to be supported by the spacer particles 19 at both sides of the heat-generating-element array, wherefore the head base body 10 can be secured to the heat radiator 40 with stability. Note that, although the heat-generating elements 13*a* constituting the heat-generating-element array are not shown in FIG. 4(*b*), as has already been described, the heat-generating element 13*a* is placed at the top of the protuberant part 12*b* of the glaze layer 12.

Moreover, in the embodiment, as shown in FIG. 4, the opposite double-sided tapes 17 on both sides of the heat-generating-element array are so arranged that the spacer particle 19 of one of them (for example, the upper one of the double-sided tapes 17 in FIG. 4(*a*)) is opposed to its respective spacer particle 19 of the other (for example, the lower one of the double-sided tapes 17 in FIG. 4(*a*)), with the heat-generating-element array lying between them. In addition, as shown in FIG. 4(*b*), the opposite spacer particles 19 are so arranged that a distance L1 from the heat-generating-element array to the spacer particle 19 within the one double-sided tape 17 is equal to a distance L2 from the heat-generating-element array to the spacer particle 19 within the other double-sided tape 17. That is, the spacer particles 19 are so arranged that, when viewed in a plan view, the heat-generating-element array is situated in a position midway between the spacer particle 19 within the one double-sided tape 17 and the spacer particle 19 within the other double-sided tape 17.

Moreover, the spacer particle 19 is configured to be higher in the coefficient of elasticity than the adhesive layer 16 and the double-sided tape 17. For example, ceramic particles, glass ceramic particles, glass particles, plastic particles, or metal particles are used for the spacer particles 19. The ceramic particles may be made of alumina or zirconia. The glass ceramic particles may be made of glass containing alumina as a filler. The glass particles may be made of soda glass or borosilicate glass. The plastic particles may be made of polyethylene, polypropylene or divinylbenzene. In the case of using plastic particles, the plastic particles may have their surfaces coated with metal for enhancement in heat-radiation property. The metal particles may be made of gold, silver, copper, aluminum or nickel.

As has already been described, since the coefficient of elasticity of the spacer particle 19 is higher than the coefficient of elasticity of the adhesive layer 16 as well as the double-sided tape 17, when the head base body 10 and the heat radiator 40 are bonded to each other via the adhesive layer 16 and the double-sided tape 17, the spacer particles 19 are each abutted against both of the lower face of the head substrate 11 and the upper face of the heat radiator 40. Thus, the interval between the lower face of the head substrate 11 and the upper face of the heat radiator 40 becomes substantially equal to the particle size of the spacer particle 19.

As shown in FIGS. 4(*a*) and 4(*b*), at the upper face of the heat radiator 40, a groove 18 is formed between the region bearing the adhesive layer 16 and the region bearing the double-sided tape 17 so as to extend along the direction of arrangement of the heat-generating elements 13*a*. The groove 18 is provided for the purpose of housing an excess adhesive which is squeezed out of the adhesive layer 16-bearing region of the upper face of the heat radiator 40 (the region between the two grooves 18 in FIG. 4(*b*)) at the time of bonding the head base body 10 onto the heat radiator 40.

Next, one embodiment of a method of manufacturing the thermal head X1 of the embodiment will be described.

To begin with, a base substrate having a plurality of head-substrate regions is prepared. Then, the glaze layer 12 is formed over the entire upper face of the base substrate by a heretofore known formation technique such for example as a printing method and a firing method.

Subsequently, a resistor film is coated over the entire upper face of the glaze layer 12 formed on each of the head-substrate regions by a heretofore known film-formation technique such for example as a sputtering technique and a vapor-deposition technique. Then, an electrically conductive film is coated over the entire upper face of the resistor film by a heretofore known film-formation technique such for example as the sputtering technique and the vapor-deposition technique.

Next, the electrically conductive film is etched in a predetermined pattern to form the electrode wiring line 14, and the electrode wiring line 14 is machined in a manner that exposes part of the resistor film for the function of acting as the heat-generating element 13*a*. At this time, a heat-generating-element array composed of the plurality of heat-generating elements 13*a* is disposed along the arrow-indicated D1-D2 direction. In effecting the etching process, a heretofore known technique such for example as a combination of a photoresist technique and a wet etching technique can be adopted.

Next, the resistor film is etched to form the electrical resistance layer 13 by a heretofore known etching technique such for example as a combination of the photoresist technique and the wet etching technique.

Next, the protective layer 15 is formed so as to cover the heat-generating element 13*a* and part of the electrode wiring line 14 by means of sputtering.

Next, the base substrate is divided into pieces on a head-substrate region-by-head-substrate region basis to obtain a plurality of head substrates 11.

Next, the wiring member is prepared. Specifically, at first, there is prepared the wiring body 31 including of the first wiring body 311, the second wiring body 312, and the wiring portion 313. Then, an adhesive constituting the first bonding layer 34 is applied to the upper face of the support plate 33 to bond the wiring body 31 with the support plate 33.

Next, a solder paste constituting the electrically conductive connecting member 49 is applied onto the first electrode wiring line 141 and the third electrode wiring line 143 of the head base body 10. The first electrode wiring line 141, as well as the third electrode wiring line 143, is opposed to the connection terminal of the wiring member 30, with the solder paste lying between them, and they are heated, thereby the first electrode wiring line 141 and the third electrode wiring line 143 are firmly fixed to the connection terminal of the wiring member 30 by the solder in a heat-molten state.

Next, the solder paste constituting the electrically conductive connecting member 49 is applied to the second electrode wiring line 142 and the third electrode wiring line 143. The second electrode wiring line 142, as well as the third electrode wiring line 143, is opposed to the connection terminal of the driving IC 20, with the solder paste lying between them. By causing the solder paste to melt through the application of heat, the second electrode wiring line 142 and the third electrode wiring line 143 are connected to the connection terminal of the driving IC 20.

Next, the head base body 10 and the wiring member 30 are bonded onto the heat radiator 40. Specifically, in the heat radiator 40 formed with the grooves 18 extending along the arrow-indicated D1-D2 direction, a heat-radiative adhesive is applied to a projected surface region of the heat radiator 40 situated between the grooves 18 by using a coating device such as a dispenser. In this way, the adhesive layer 16 is formed.

On the other hand, the double-sided tape 17 is attached to other region of the upper face of the heat radiator 40 than the projected surface region situated between the grooves 18. After that, the spacer particles 19 are arranged in a row at a predetermined spacing on the upper face of the double-sided tape 17 by means of a dispenser or otherwise. The diameter of the spacer particle 19 is substantially equal to the thickness of the double-sided tape 17. In terms of the sequence of process, the step of applying the heat-radiative adhesive and the step of attaching the double-sided tape 17 and arranging the spacer particles 19 may change their places.

Then, the head base body 10 is placed on the heat radiator 40 bearing the adhesive layer 16 and being stuck the double-sided tape 17. Upon pushing the head base body 10 on the adhesive layer 16 and the double-sided tape 17, the spacer particles 19 are pressed into the double-sided tape 17 by the lower face of the head substrate 11, and the embedded spacer particles 19 are contacted by the upper face of the heat radiator 40. In consequence, the spacer particles 19 are kept in abutting contact with both of the head substrate 11 and the heat radiator 40. Moreover, the head substrate 11 is thereby bonded to the adhesive layer 16 and the double-sided tape 17, thus permitting bonding of the head base body 10 with the heat radiator 40.

It is also possible to attach a double-sided tape embedded in advance with spaced spacer particles to the upper face of the heat radiator 40.

In the manner as above described, the thermal head X1 of the embodiment is constructed.

<Recording Device>

Now, an embodiment of a thermal printer implemented by way of one embodiment of a recording device pursuant to the invention will be described with reference to the drawings.

Figure 5:
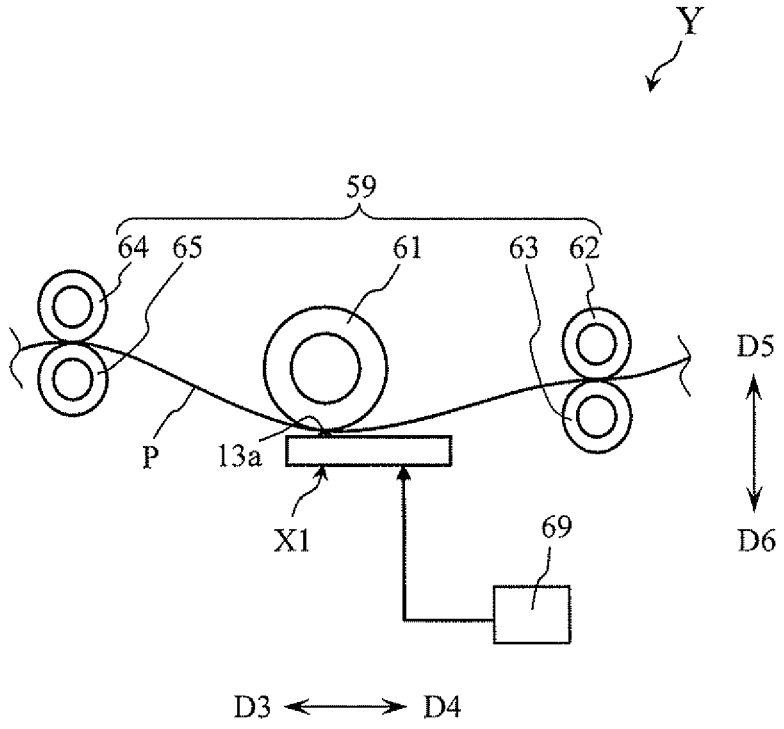
FIG. 5 is a diagram showing a general structure of a thermal printer implemented by way of one embodiment of a recording device pursuant to the invention.

As shown in FIG. 5, a thermal printer Y of the present embodiment includes the thermal head X1 thus far described, a conveyance mechanism 59, and a control mechanism 69.

The conveyance mechanism 59 has the function of conveying a recording medium P in the arrow-indicated D3 direction while pressing the recording medium P on the heat-generating element 13*a* of the thermal head X1. The conveyance mechanism 59 includes a platen roller 61 and conveying rollers 62, 63, 64, and 65.

The platen roller 61 has the function of pressing the recording medium P on the heat-generating element 13*a*. The platen roller 61 is rotatably supported in contact with the protective layer 15 situated on the heat-generating element 13*a*. The platen roller 61 is constructed by applying a coating of an elastic member to an outer surface of a cylindrical base body. The base body is made of metal such for example as stainless steel. The elastic member is made for example of butadiene rubber having a thickness dimension of 3 mm to 15 mm.

The conveying rollers 62, 63, 64, and 65 have the function of conveying the recording medium P. That the conveying rollers 62, 63, 64, and 65 act to feed the recording medium P to a space between the heat-generating element 13*a* of the thermal head X1 and the platen roller 61, as well as to pull the recording medium P out of the space between the heat-generating element 13*a* of the thermal head X1 and the platen roller 61. For example, like the platen roller 61, each of the conveying rollers 62, 63, 64, and 65 may be constructed by applying a coating of an elastic member to an outer surface of a cylindrical base body.

The control mechanism 69 has the function of supplying image information to the driving IC 20. That is, the control mechanism 69 acts to supply image information for driving the heat-generating elements 13*a* in a selective manner to the driving IC 20 via the external connection terminal 32.

In the thermal printer Y of the embodiment, as shown in FIG. 5, the recording medium P is conveyed onto the thermal head X1 by the conveyance mechanism 59, and the heat-generating elements 13*a* of the thermal head X1 are driven to produce heat in a selective manner by the control mechanism 69. The thermal printer Y is thus capable of effecting printing on the recording medium P in a predetermined fashion.

According to the thermal head X1 of the embodiment described previously, the spacer particles 19 are arranged within the double-sided tape 17 so as to abut on both of the heat radiator 40 and the head substrate 11. Thereby, when the recording medium is pressed on the heat-generating element 13*a* by the platen roller, etc., since the head substrate 11 is supported by the spacer particles 19, it is possible to lessen the occurrence of a tilt of the head base body 10. This makes it possible to suppress that, for example, the force exerted by the platen roller, etc., to press the recording medium on the heat-generating element 13*a* decreases in strength, or separation occurs between the head base body 10 and the adhesive layer 16 as well as the double-sided tape 17, due to the tilt of the head base body 10.

Moreover, according to the thermal head X1 of the embodiment, the adhesive layer 16 situated immediately below the heat-generating-element array composed of the plurality of heat-generating elements 13*a* is free of the arrangement of the spacer particles 19. The spacer particles 19 are arranged in the double-sided tapes 17 which are located on both sides of the adhesive layer 16 and extend in parallel with the adhesive layer 16. Since no spacer particle 19 exists in the region situated immediately below the heat-generating-element array (the first region), it is possible to reduce variations in heat-generating temperature among the heat-generating elements 13*a* constituting the heat-generating-element array. That is, in the case where the spacer particles 19 are arranged in that region of the adhesive layer 16 located immediately below the heat-generating-element array, due to the scattering of the spacer particles 19, heat-radiation property varies over different portions of the adhesive layer 16, which results in variations in heat-generating temperature among the heat-generating elements 13*a* constituting the heat-generating-element array. Furthermore, in this case, a gap is created between the adhesive layer 16 and the spacer particle 19 embedded therein, and this gap could be causative of heat-radiation property variations in the adhesive layer 16. In contrast, in the thermal head X1 of the embodiment, since no spacer particle 19 exists in the region situated immediately below the heat-generating-element array, which exerts a significant influence upon the heat-generating temperature of each of the heat-generating elements 13*a* constituting the heat-generating-element array, it is possible to reduce variations in heat-generating temperature among the heat-generating elements 13*a* constituting the heat-generating-element array.

Moreover, according to the thermal head X1 of the embodiment, since the spacer particles 19 are arranged within the double-sided tape 17, it is easy to arrange the spacer particles 19 in predetermined positions. That is, in the case of arranging the spacer particles 19 within the adhesive layer 16, the spacer particles 19 tend to move with the flowing motion of the adhesive in a yet-to-be-cured state. This makes it difficult to arrange the spacer particles 19 in predetermined positions. In contrast, in the case of arranging the spacer particles 19 within the double-sided tape 17, since the spacer particles 19 are less likely to move within the double-sided tape 17, it is possible to facilitate the arrangement of the spacer particles 19 in predetermined positions.

Moreover, according to the thermal head X1 of the embodiment, as shown in FIG. 4(*b*), the spacer particles 19 are so arranged that the distance L1 from the heat-generating-element array to the spacer particle 19 within one of the double-sided tapes 17 is equal to the distance L2 from the heat-generating-element array to the spacer particle 19 within the other one of the double-sided tapes 17. Therefore, when the recording medium is pressed on the heat-generating element 13*a* constituting the heat-generating-element array by the platen roller, the pressing at a predetermined position on the heat-generating element 13*a* can be achieved. This helps suppress occurrence of the fading of print quality, etc., resulting from displacement of pressing position. That is, in the case where the distance L1 and the distance L2 are unequal, when the recording medium is pressed on the heat-generating element 13*a* by the platen roller, in a direction perpendicular to the direction of arrangement of the heat-generating elements 13*a* (the D3-D4 direction), a point of the head base body 10 which is most subjected to distortion (hereafter referred to as "maximally distorted point") becomes out of alignment with the axis of the platen roller. In the end, the platen roller applies a pressing force to a position displaced from a predetermined pressing position on the heat-generating element 13*a*. More specifically, the platen roller applies a pressing force to a position displaced in a direction opposite to the direction of displacement of the maximally distorted point from the predetermined pressing position on the heat-generating element 13*a*. In contrast, as practiced in the embodiment, where the distance L1 and the distance L2 are equal, the maximally distorted point of the head base body 10 is brought into coincidence with the axis of the platen roller. Therefore, since the pressing at the predetermined position on the heat-generating element 13*a* by the platen roller can be achieved, it is possible to suppress occurrence of the fading of print quality, etc., resulting from the displacement of the pressing position.

While the invention has thus far been explained by way of one embodiment, it is to be understood that the invention is not so limited but is susceptible of various changes and modifications without departing from the gist of the invention.

Figure 6:
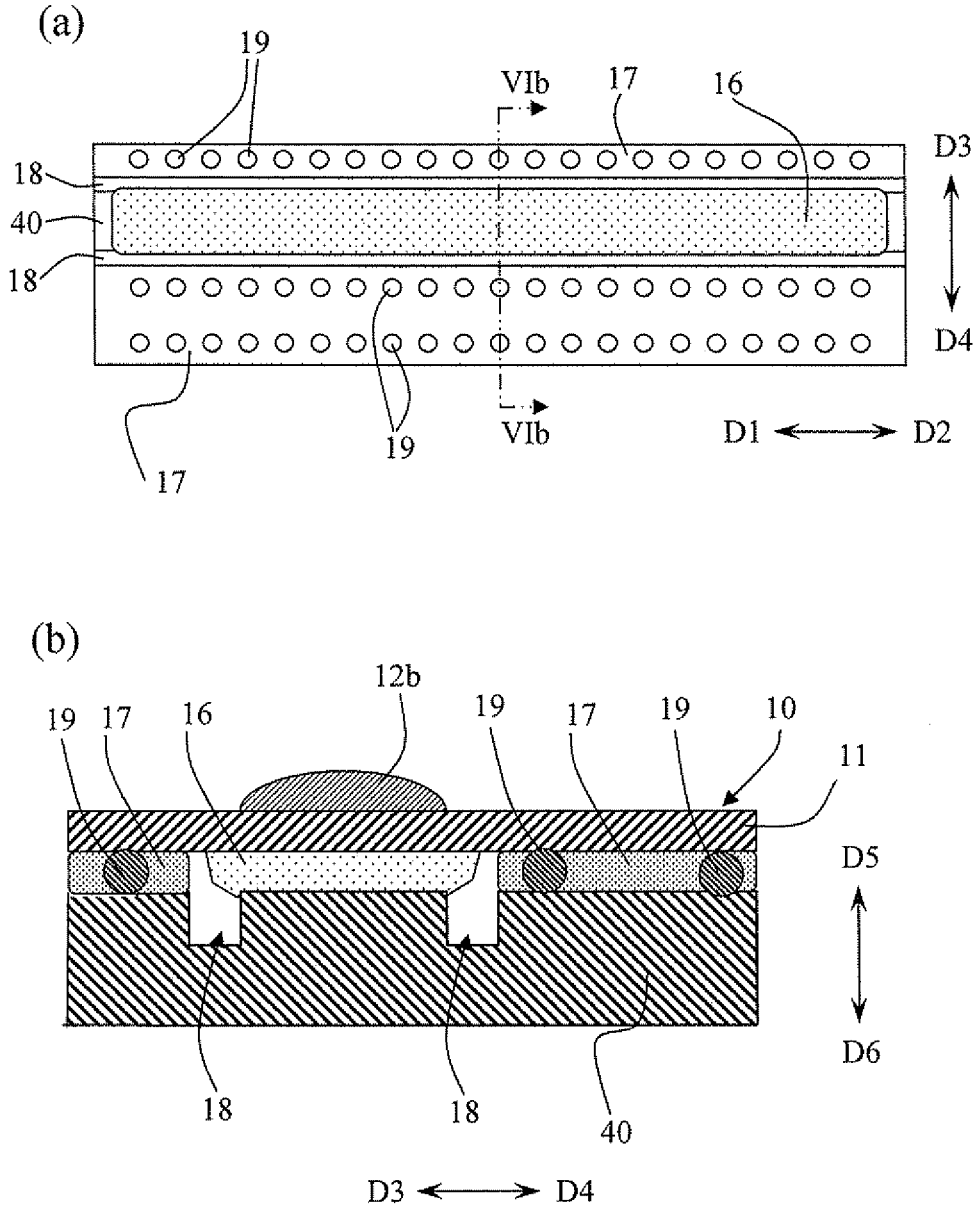
FIG. 6(*a*) is a plan view, with the head base body omitted, schematically showing a modified example of the state of connection between the head base body and the heat radiator shown in FIG. 1, and FIG. 6(*b*) is a sectional view taken along the line VIb-VIb of FIG. 6(*a*)

That is, in the thermal head X1 of the embodiment, as shown in FIG. 4, one spacer particle 19 is placed at each of the opposite ends of the double-sided tape 17 in the direction of arrangement of the heat-generating elements 13*a*, and also one spacer particle 19 is placed at the midportion thereof in that direction. However, the number of the spacer particles 19 and the positions of their placement are not so limited. For example, as shown in FIG. 6, a plurality of spacer particles 19 (21 spacer particles in the figure) may be arranged at a predetermined spacing in a row in one of the double-sided tapes 17, whereas a plurality of spacer particles 19 (21 spacer particles in the figure) may be arranged at a predetermined spacing in two rows in the other one of the double-sided tapes 17.

Figure 7:
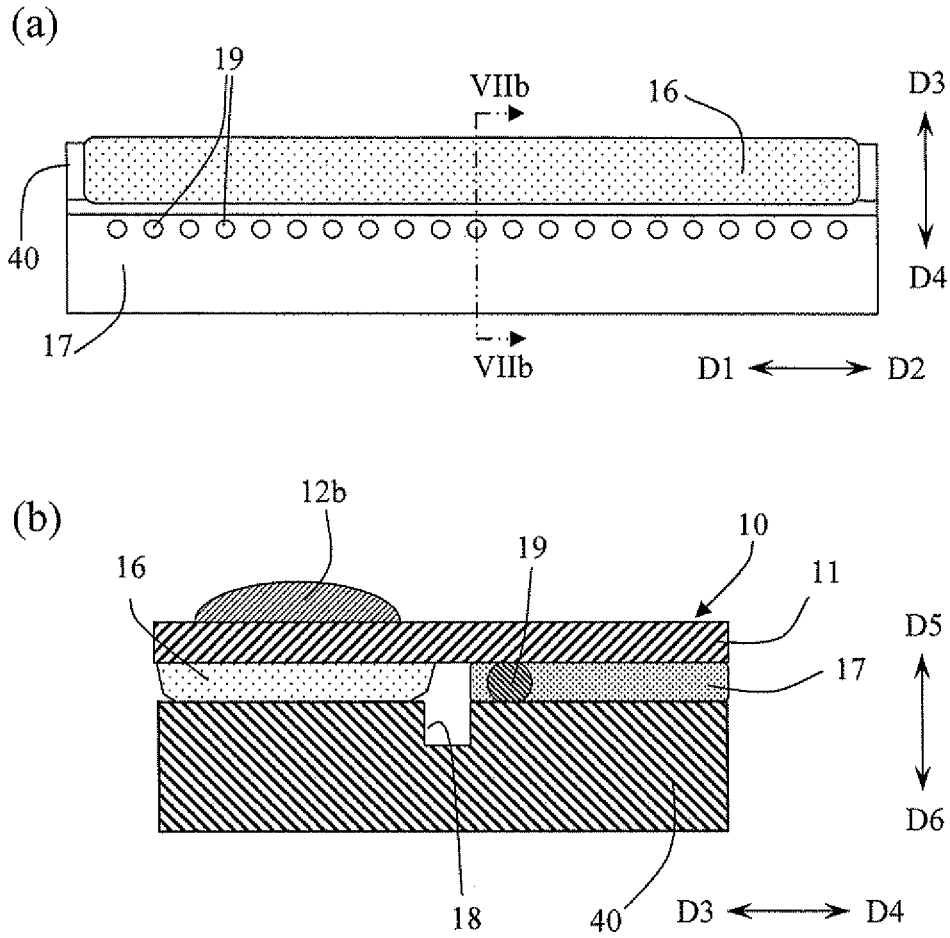
FIG. 7(*a*) is a plan view, with the head base body omitted, schematically showing a modified example of the state of connection between the head base body and the heat radiator shown in FIG. 1, and FIG. 7(*b*) is a sectional view taken along the line VIIb-VIIb of FIG. 7(*a*)

Moreover, in the thermal head X1 of the embodiment, as shown in FIG. 4, the head base body 10 (more particularly, the head substrate 11) is bonded onto the heat radiator 40 via the double-sided tapes 17 on both sides of the adhesive layer 16 in a direction perpendicular to the direction of arrangement of the heat-generating elements 13*a* (the D3-D4 direction). However, the invention is not so limited. For example, as shown in FIG. 7, the head base body 10 may be bonded onto the heat radiator 40 via the double-sided tape 17 on one side of the adhesive layer 16 in the D3-D4 direction.

Figure 8:
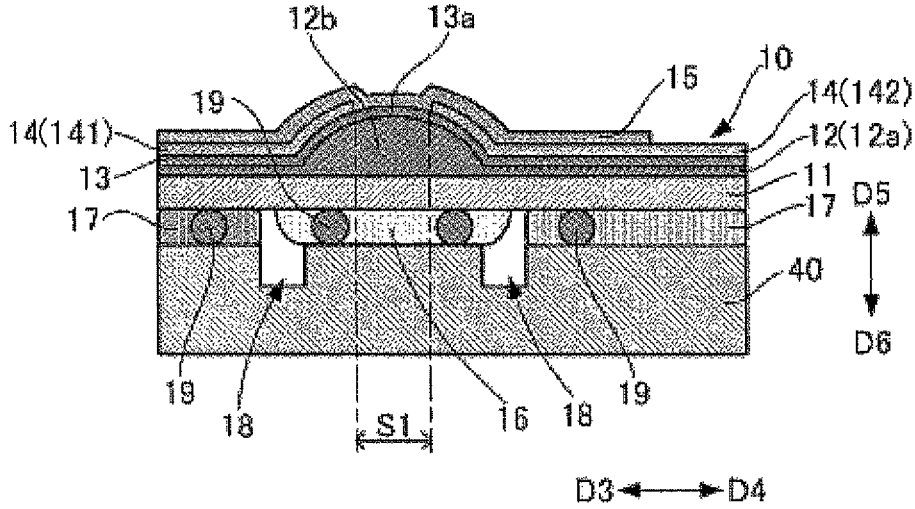
FIG. 8 is a sectional view schematically showing a modified example of the state of connection between the head base body and the heat radiator shown in FIG. 4(*b*)

Moreover, in the thermal head X1 of the embodiment, as shown in FIG. 4, the spacer particle 19 is not disposed in the adhesive layer 16. However, the invention is not so limited in so far as no spacer particle 19 exists in the region situated immediately below the heat-generating-element array composed of the plurality of heat-generating elements 13*a*. For example, as shown in FIG. 8, the spacer particle 19 may be disposed in other region of the adhesive layer 16 than the first region 81 situated immediately below the heat-generating-element array composed of the plurality of heat-generating elements 13*a*. Note that, in FIG. 8, with the aim of showing the positional relationship between the first region S1 situated immediately below the heat-generating-element array and the spacer particle 19, the glaze layer 12, the electrical resistance layer 13, the electrode wiring line 14, and the protective layer 15 lying on the head substrate 11 are schematically shown.

Figure 9:
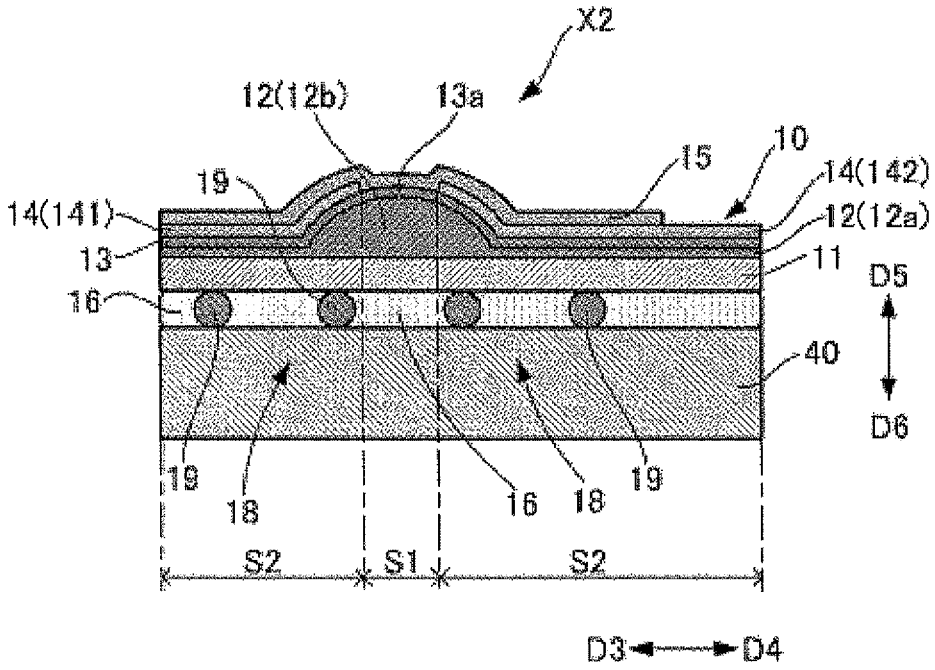
FIG. 9 is a sectional view schematically showing a modified example of the state of connection between the head base body and the heat radiator shown in FIG. 4(*b*)

Moreover, in the thermal head X1 of the embodiment, the heat radiator 40 and the head substrate 11 of the head base body 10 are bonded to each other by the adhesive layer 16 and the double-sided tape 17. However, the bonding layer of the invention is not limited to the configuration based on the adhesive layer and the double-sided tape in so far as no spacer particle 19 exists in the region situated immediately below the heat-generating-element array composed of the plurality of heat-generating elements 13*a*. For example, the double-sided tape 17 may be disposed in place of the adhesive layer 16 shown in FIG. 4. In this case, the heat radiator 40 and the head substrate 10 of the head base body 10 are bonded to each other by the bonding layer composed solely of the double-sided tapes 17. On the other hand, the adhesive layer 16 may be disposed in place of the double-sided tape 17 shown in FIG. 4. In this case, the heat radiator 40 and the head substrate 11 of the head base body 10 are bonded to each other by the bonding layer composed solely of the adhesive layers 16. In another alternative, as shown in FIG. 9, the heat radiator 40 and the head substrate 11 of the head base body 10 may be bonded to each other by a single adhesive layer 16. In this case, the adhesive layer 16 by itself corresponds to the bonding layer of the invention, and includes the first region S1 situated immediately below the heat-generating-element array and the second regions S2 extending in parallel with the first region. Note that, in the adhesive layer 16 shown in FIG. 9, no spacer particle 19 exists in the first region S1 situated immediately below the heat-generating-element array composed of the plurality of heat-generating elements 13*a*. In addition, the groove 18 as formed in the heat radiator 40 shown in FIG. 4 is not formed at the upper face of the heat radiator 40 shown in FIG. 9.

Figure 10:
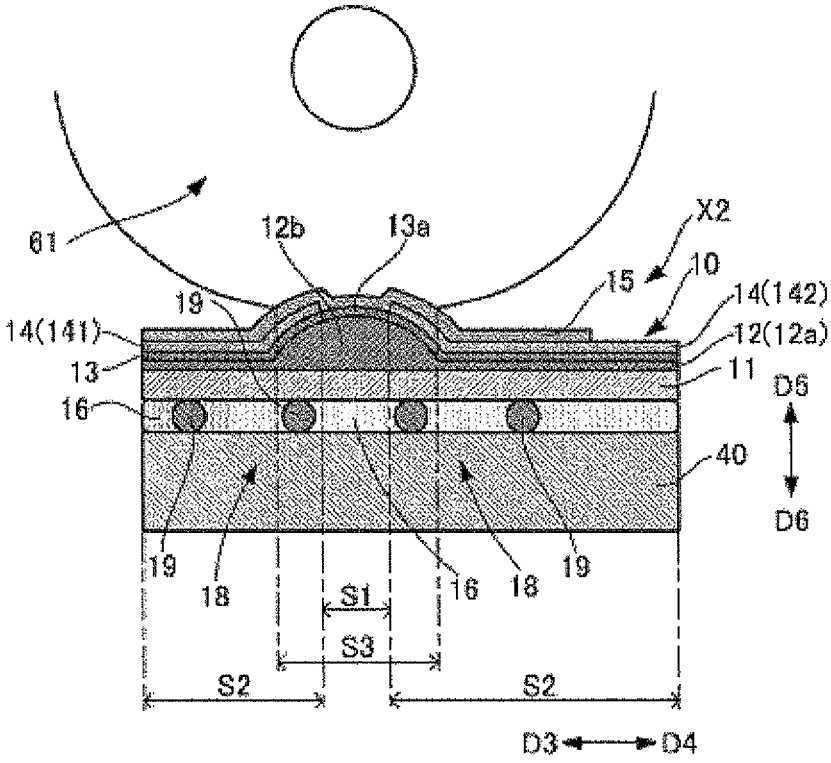
FIG. 10 is an enlarged schematic structural diagram showing a main part of the thermal printer shown in FIG. 5 employing the thermal head shown in FIG. 9 as its thermal head.

Moreover, for example, in the case of employing a thermal head X2 as shown in FIG. 9 instead of the thermal head X1 applied to the thermal printer Y of the embodiment, as shown in FIG. 10, in the adhesive layer 16, the spacer particle 19 may be disposed in a region S3 corresponding to the region of contact between the thermal head X2 and the platen roller 61, excluding the first region S1 situated immediately below the heat-generating-element array. In this case, other region of the adhesive layer 16 than the first region S1 corresponds to the second region (S2) extending in parallel with the first region (S1). In the thermal head thereby constructed, since no spacer particle 19 exists in the first region S1 situated immediately below the heat-generating-element array, as has already been described, it is possible to reduce variations in heat-generating temperature among the heat-generating elements 13*a* constituting the heat-generating-element array. Moreover, in this case, the head base body 10 can be supported by the spacer particles 19 in the region situated immediately below the region of contact between the thermal head X2 and the platen roller 61. This makes it possible to apply a pressing force exerted by the platen roller 61 onto the heat-generating element 13*a* more effectively.

In the case where the head substrate 11 of the head base body 10 is made thin (with a thickness as small as 1 mm or less) from the standpoint of thermal conductivity, since the head substrate 11 becomes deformed readily, it follows that the invention is of great utility. Moreover, also in the case where the head substrate 11 has a length greater than or equal to 100 mm, that is, where the heat-generating-element array is made long, since the head substrate 11 becomes deformed readily, it follows that the invention is of great utility. Further, also in the case where the width (the length in the D3-D4 direction) of the head substrate 11 is less than or equal to 10 mm, since the head substrate 11 becomes deformed readily, it follows that the invention is of great utility.

Especially in the field of imaging or medical recording head development, since there is a trend toward an increase in the length of the head substrate 11, it follows that the invention is of great utility.

Now, a comparison is performed between an example and a comparative example of the thermal head X1 shown in FIG. 4.

To begin with, in order to produce a thermal head A as an example of the thermal head X1 shown in FIG. 4, a head base body and a heat radiator were prepared. The head base body is constructed of a head substrate made of an alumina substrate which is 9 mm in width, 168 mm in length, and 1 mm in thickness. The head substrate is formed with a heat-generating-element array extending along the direction of the length thereof. The heat radiator is made of Al, and is 20 mm in width, 170 mm in length, and 4 mm in thickness. The heat radiator has two grooves formed on opposed sides of a part thereof corresponding to the heat-generating-element array.

A 50 μm-thick double-sided tape (Tape 467: acrylic adhesive transfer tape of base material-free type manufactured by 3M) was attached to other region of the upper face of the heat radiator than the projected surface region situated between the grooves. On the double-sided tape were arranged spacer particles (Micropearl: Type AU-250 manufactured by Sekisui Chemical Co., Ltd), the particles size of which is equal to the thickness of the double-sided tape.

As shown in FIG. 4, when viewed in the direction in which the groove is formed, there are arranged three spacer particles at the opposite ends and the midportion, respectively, of the upper face of each of double-sided tapes which are arranged on both sides of the groove, in a linear fashion.

After that, heat-radiative resin of thermosetting type (TSE 3282G manufactured by Toshiba Silicone Co., Ltd) has been applied, in a thickness of 50 μm, to the projected surface region of the heat radiator situated between the grooves by means of a dispenser.

Next, the head base body was placed on the heat-radiative resin and the upper face of the double-sided tapes bearing the spacer particles, and a flat surface region between the heat-generating-element array and the driving IC has been pressed toward the heat radiator by a pressing machine. Then, heat has been applied for 1 hour at 90° C. to cure the heat-radiative resin. In this way, the thermal head A of the example of the thermal head X1 of the invention was constructed.

Moreover, a thermal head B was constructed as a comparative example basically in the same manner as adopted in the construction of the thermal head A except that the spacer particles were not arranged within the double-sided tape but were contained within the heat-radiative resin, and the spacer particle-containing heat-radiative resin has been applied to the projected surface region of the heat radiator situated between the grooves by means of a dispenser. Further, a thermal head C was constructed as another comparative example basically in the same manner as adopted in the construction of the thermal head A except that neither of the double-sided tape and the heat-radiative resin includes the spacer particles.

The thermal heads A, B, and C thereby constructed were each mounted in a high-speed color printer for printing tests. Synthetic paper was used as a recording medium.

Figure 11:
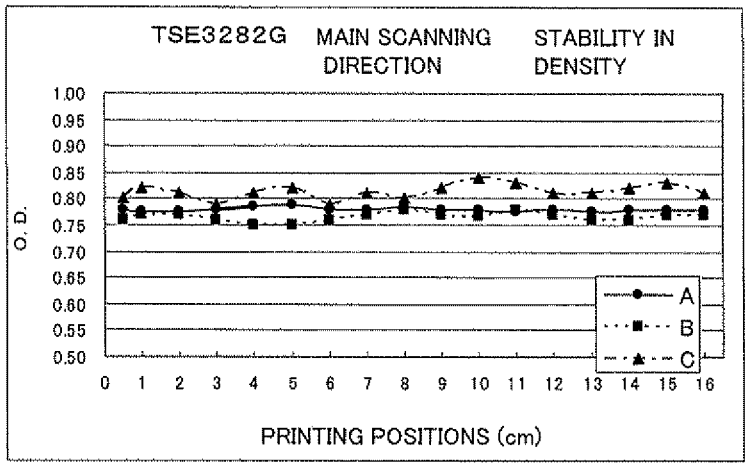
FIG. 11 is diagrams showing results of print density measurement, wherein FIG. 11(*a*) is a graph indicating a result of measurement as to a location spaced 10 cm away from the printing starting position in the subscanning direction, FIG. 11(*b*) is a graph indicating a result of measurement as to a location spaced 20 cm away from the printing starting position in the subscanning direction, and FIG. 11(*c*) is an explanatory view for illustrating locations for print density measurement.
Figure 11:
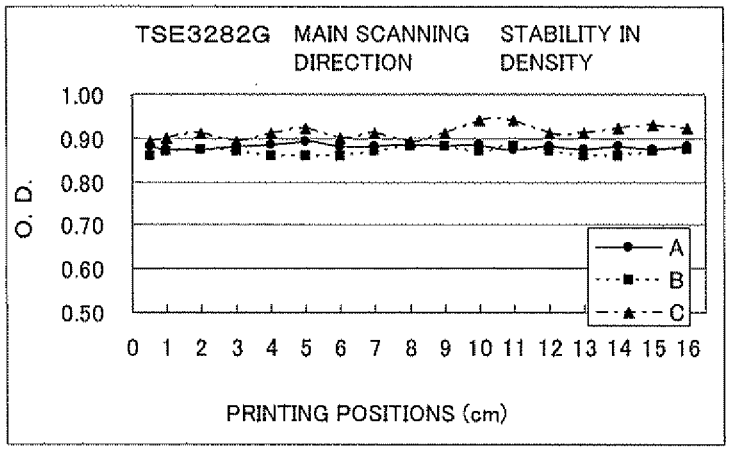
Figure 11:
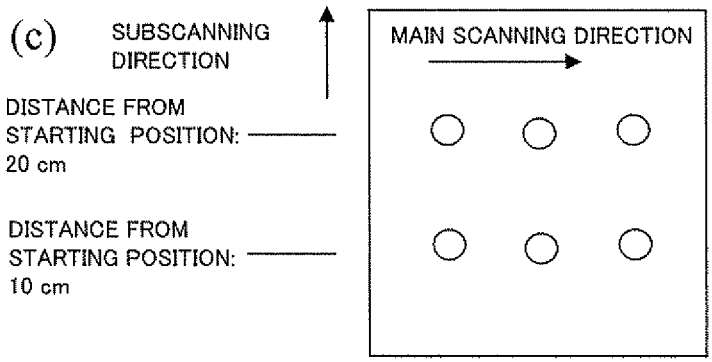

As shown in FIG. 11(*c*), a starting position for printing was set at 0. In a location spaced 10 cm away from the printing starting position, as well as a location spaced 20 cm away from the printing starting position in the subscanning direction, several points arranged at regular intervals in the main scanning direction have been subjected to print density measurement for observation of stability in density. The results are shown in FIGS. 11(*a*) and 11(*b*). In the graphs shown in FIGS. 11(*a*) and 11(*b*), the ordinate axis indicates density (O.D.), and the abscissa axis indicates printing positions in the main scanning direction (distances from the end of print region).

As will be understood from FIG. 11, the thermal head A showed no sign of significant change of density in the main scanning direction. That is, the heat-radiative resin, being free of the spacer particle 19, is able to exhibit uniformity in heat-radiation distribution, wherefore printing can be achieved with stability. Note that, although the extent of heat accumulation in the glaze layer at the location spaced 20 cm away from the printing starting position is greater than that at the location spaced 10 cm away from the printing starting position, printing can be achieved with stability even under such a condition.

On the other hand, in the thermal head B provided as the comparative example, since the spacer particles are contained within the heat-radiative resin, and the spacer particles are distributed unevenly within the heat-radiative resin, this gave rise to lack of uniformity in heat-radiation property, which resulted in unevenness in density.

Furthermore, in the thermal head C provided as another comparative example, since neither of the heat-radiative resin and the double-sided tape includes the spacer particles, this gave rise to a tilt of the head base body, which resulted in unevenness in density.

Reference Signs List

X1, X2: Thermal head (Recording head)
Y: Thermal printer (Recording device)
10: Head base body
11: Head substrate (Substrate)
12: Glaze layer
13: Electrical resistance layer
13*a*: Heat-generating element
14: Electrode wiring line
141: First electrode wiring line
142: Second electrode wiring line
143: Third electrode wiring line
15: Protective layer
16: Adhesive layer
17: Double-sided tape
18: Groove
19: Spacer particle
20: Driving IC
30: Wiring member
40: Heat radiator
59: Conveyance mechanism
61: Platen roller
62, 63, 64, 65: Conveying roller
69: Control mechanism
P: Recording medium
S1: First region
S2: Second region
S3: Region corresponding to region of contact between thermal head and platen roller

The invention claimed is:

1. A recording head, comprising:
a heat radiator;
a head base body having a substrate placed on or above the heat radiator and a heat-generating-element array composed of a plurality of heat-generating elements arranged on or above the substrate;
a bonding layer that is interposed between the heat radiator and the substrate and bonds the heat radiator with the substrate; and
a plurality of spacer particles arranged within the bonding layer so as to abut on both of the heat radiator and the substrate,
the bonding layer including a first region situated immediately below the heat-generating-element array and a second region extending in parallel with the first region,
the spacer particles being arranged in the second region but not being arranged in the first region.

2. The recording head according to claim 1,
wherein the second region of the bonding layer is formed of a double-sided tape.

3. The recording head according to claim 1,
wherein the first region of the bonding layer is formed of an adhesive.

4. The recording head according to claim 1,
wherein the spacer particles are arranged along the heat-generating-element array.

5. The recording head according to claim 1,
wherein second regions of the bonding layer are arranged on both sides of the first region.

6. The recording head according to claim 5,
wherein the spacer particle placed in one of the second regions of the bonding layer is opposed to the spacer particle placed in another one of the second regions, with the first region lying between them, and
wherein a distance from the heat-generating-element array to the spacer particle placed in the one of the second regions is equal to a distance from the heat-generating-element array to the spacer particle placed in the other one of the second regions.

7. A recording device, comprising:
the recording head according to claim 1; and
a conveyance mechanism configured so as to convey a recording medium onto the plurality of heat-generating elements,
the conveyance mechanism having a platen roller configured to press the recording medium on the plurality of heat-generating elements.

8. The recording device according to claim 7,
wherein the second region of the bonding layer extends at least to a region corresponding to a region of contact between the recording head and the platen roller,
and wherein the spacer particle is placed in a part of the second region of the bonding layer which corresponds to the region of contact.

* * * * *